US011370589B2

(12) United States Patent
Garcia et al.

(10) Patent No.: US 11,370,589 B2
(45) Date of Patent: Jun. 28, 2022

(54) PACKAGE WITH BLISTER AS SUPPORT FOR PRODUCT

(71) Applicant: WestRock MWV, LLC, Norcross, GA (US)

(72) Inventors: Francisco J. Garcia, Long Beach, CA (US); Meng-Chuan Wu, Richmond, VA (US); Gregory P. Hayter, Richmond, VA (US); Matthew E. Zacherle, Chesterfield, VA (US); Mary Kathryn Suttle, Raleigh, NC (US)

(73) Assignee: WESTROCK MWV LLC, Atlanta, GA (US)

( * ) Notice: Subject to any disclaimer, the term of this patent is extended or adjusted under 35 U.S.C. 154(b) by 1247 days.

(21) Appl. No.: 15/038,593

(22) PCT Filed: Nov. 26, 2014

(86) PCT No.: PCT/US2014/067527

§ 371 (c)(1),
(2) Date: May 23, 2016

(87) PCT Pub. No.: WO2015/081150

PCT Pub. Date: Jun. 4, 2015

(65) Prior Publication Data

US 2016/0297587 A1 Oct. 13, 2016

Related U.S. Application Data

(60) Provisional application No. 61/908,830, filed on Nov. 26, 2013.

(51) Int. Cl.
*B65D 73/00* (2006.01)

(52) U.S. Cl.
CPC ..... *B65D 73/0014* (2013.01); *B65D 73/0064* (2013.01)

(58) Field of Classification Search
CPC ..... B65D 73/00; B65D 73/0092; B65D 73/0014; B65D 73/0064
See application file for complete search history.

(56) References Cited

U.S. PATENT DOCUMENTS 3,203,542 A * 8/1965 Lightner ..... B65D 73/0092 206/463
3,918,583 A * 11/1975 Adams ..... B65D 73/0085 206/779
4,261,462 A * 4/1981 Wysocki ..... B65D 73/0057 206/216

(Continued)

FOREIGN PATENT DOCUMENTS

WO WO2012115836 8/2012

OTHER PUBLICATIONS

International preliminary report on patentability, International Search Report, and Written Opinion for PCT/US2014/067527, dated Jun. 9, 2016.

*Primary Examiner* — Anthony D Stashick
*Assistant Examiner* — Blaine G Neway

(57) ABSTRACT

A package is described for housing a product supported upon a blister portion of the package. The product may be an item whose weight may be supported by the blister. For some products such as cables, wires, or hoses the product may also be held in a desired shape.

7 Claims, 22 Drawing Sheets

(56) References Cited

U.S. PATENT DOCUMENTS

| | | | | |
|---|---|---|---|---|
| 4,634,005 | A * | 1/1987 | Kulzer | B65D 73/0064 206/349 |
| 5,002,187 | A * | 3/1991 | Rysner | B65D 75/36 206/459.5 |
| 6,968,950 | B2 * | 11/2005 | Eisenbraun | B65D 75/36 206/461 |
| 7,475,779 | B2 * | 1/2009 | Kellar | B41J 2/17533 206/462 |
| 7,931,147 | B2 * | 4/2011 | Petrelli | B65D 73/0092 206/461 |
| 8,534,463 | B2 * | 9/2013 | Smith | B65D 75/366 206/775 |
| 9,731,882 | B2 * | 8/2017 | Lee | B65D 75/32 |
| 9,980,798 | B2 * | 5/2018 | Moskovich | B65D 75/366 |
| 2008/0017542 | A1 | 1/2008 | Le et al. | |
| 2011/0240503 | A1 | 10/2011 | Bailey | |
| 2012/0325703 | A1 | 12/2012 | Sorrentino et al. | |
| 2013/0056375 | A1 | 3/2013 | Albrecht et al. | |

* cited by examiner

208

110
150B
120
150C
H
110
150B
120
150C
H

214

120
S
110

120
110
150F
S
150H 110
120
150F 150F
110
120

PACKAGE WITH BLISTER AS SUPPORT FOR PRODUCT

REFERENCE TO RELATED APPLICATION

This application is a National Phase entry into the United States of International Application PCT/US14/67527 filed on Nov. 26, 2014 which claims the benefit of priority under 35 U.S.C. § 119(e) of U.S. provisional application Ser. No. 61/908,830 filed on Nov. 26, 2013, and both of the above applications are hereby incorporated by reference in its entirety

BACKGROUND

This disclosure relates to a package for a product supported upon a blister portion of the package. The product may be a cable or hose or similar item whose weight may be supported by the blister while the product is also held in a desired shape.

Certain products such as cables or hoses may be housed in paperboard packages that may be hung on hooks or otherwise displayed in retail stores. Due to the weight of these products, they may sag on the package. A package is therefore sought that would better support the product.

The current invention seeks to provide a new package which adequately supports a variety of products while holding the product in a preferred shape. While cables, hoses, and tools are suitable products for such a package, the disclosed packages may hold other items as well.

SUMMARY

According to one embodiment of the invention, there is provided a package including a base made of sheet material with a first channel with two open ends; and a blister attached to the base, the blister including a shoulder portion at least partly forming an interior wall of the first channel.

In certain embodiments, the base includes a front panel and a back panel, and the blister may include a flange received between the front panel and back panel. In certain embodiments, the base may be one ply of sheet material and the blister may be attached to a front surface of the base.

In certain embodiments, the package may include a second channel with two open ends. In certain embodiments, the shoulder portion forming an interior wall of the channel may be a curved surface.

In certain embodiments, the first channel is formed by a series of panels hingedly attached to one another and to the base. In certain embodiments, a proximal end of the first channel is attached to the base through a fold line, and a distal end of the first channel is glued or taped to the base.

In certain embodiments, the sheet material is paperboard. In certain embodiments, the blister is plastic.

According to another embodiment, there is provided a package for holding a product item, the package include a base made of sheet material; a first blister portion attached to the base, the first blister portion shaped to receive at least a portion of the product item, while leaving the product item substantially exposed; and a holding feature attached to the base and securing the product item to the package.

In certain embodiments, the base includes a front panel and a back panel, and the first blister portion includes a flange received between the front panel and back panel.

In certain embodiments, the base includes at least one ply of sheet material and the first blister portion is attached to a front surface of the base.

In certain embodiments, the holding feature is a second blister portion attached to the base.

In certain embodiments, the holding feature is a strap of sheet material attached to the base. In certain embodiments, the holding feature wraps around the product item.

In certain embodiments, the holding feature is a strap of paperboard or plastic.

In certain embodiments, the strap has at least one end, the base includes two plies of material, and the at least one end is sealed between said two plies.

In certain embodiments the sheet material is paperboard.

In certain embodiments, the first blister portion is plastic.

Other exemplary and optional features of the invention will be apparent from the following description and from the subsidiary claims.

BRIEF DESCRIPTION OF DRAWINGS

The invention will now be further described, merely by way of example, with reference to the accompanying drawings, in which:

FIGS. 18A-20D are perspective views of additional packages;

DETAILED DESCRIPTION

Packages are described which utilize a blister trap-sealed between a front and back panel. The blister may provide support for a product to rest on, and may distribute the product weight to the panels. The blister may be sealed to the paperboard to provide rigidity for the package.

The blister size and shape may be chosen according to manufacturing preference and to provide adequate space for products to rest onto, wrap around, or hook onto. The blister may be designed to help hold the product in a desired shape. An example described herein is a curved blister around which cables may be wrapped. The blister may have formed or cut out areas where paperboard may engage the blister. The blister may be designed with particular shapes, dimensions, angles, etc. to help form and support the paperboard, and prevent it from being crushed.

Figure 1:
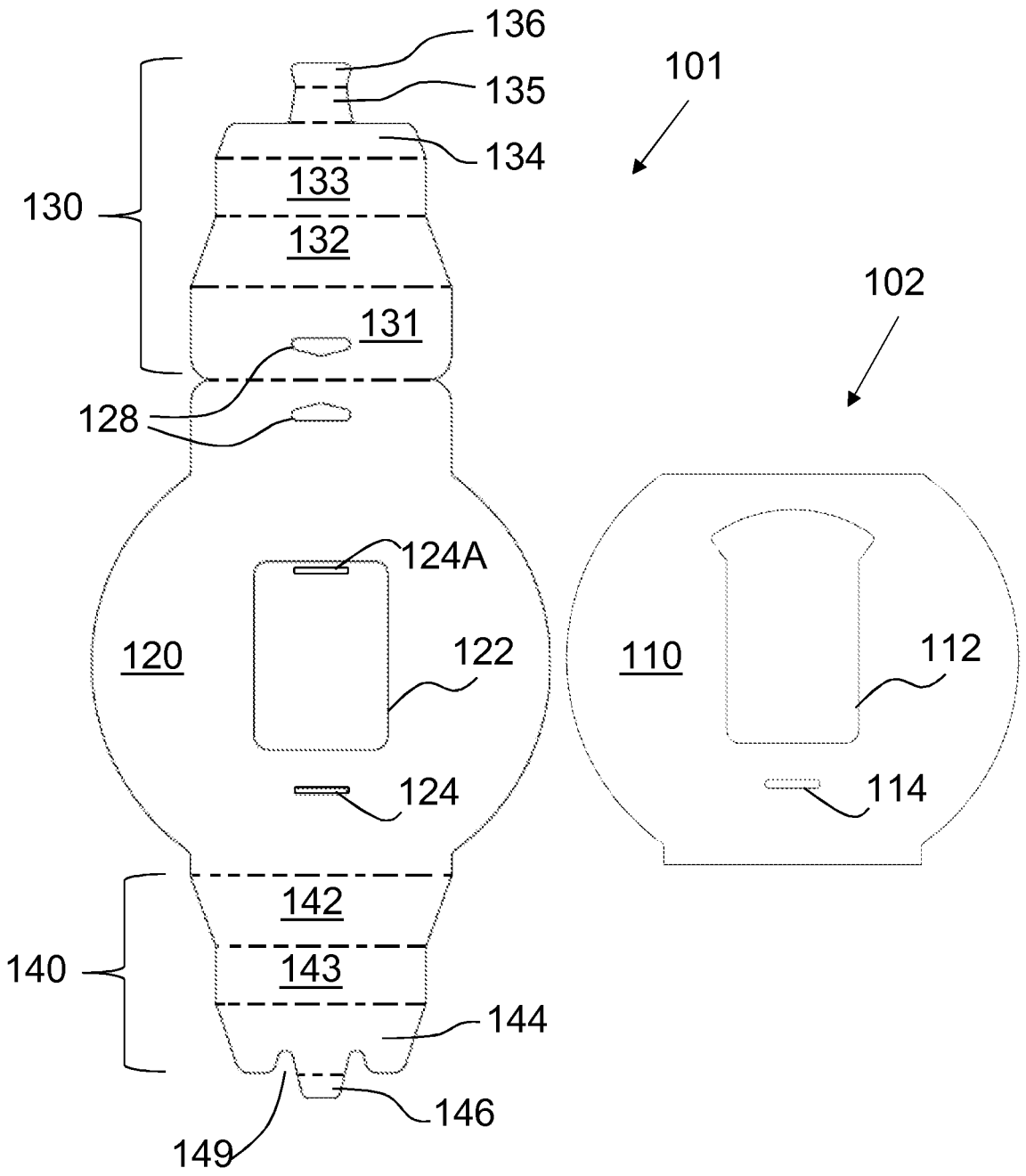
FIG. 1 is a plan view of blanks for making a package.

FIG. 1 is a plan view of blanks for making a package. Back blank 101 may include back panel 120, hingedly connected to upper channel 130 and lower channel 140. Upper channel 130 may include fold-back panel 131, upper channel outer wall 132, upper channel roof 133, upper channel inner wall 134, upper channel pass-through tab 135, and upper channel glue tab 136. Lower channel 140 may include lower channel outer wall 142, lower channel roof 143, lower channel inner wall 144, and lower channel glue tab 146. The various portions of back blank 101 may be connected through fold lines.

Certain apertures may be provided in back blank 101, including hang holes 128 on fold-back panel 131 and back panel 120. A lower slot 124 may be provided on back panel 120. Also at least one of a back panel cutout 122 and/or upper slot 124A may be provided on back panel 120.

Front blank 102 may include front panel 110 that may have a size and shape similar to back panel 120. Certain apertures may be provided in front panel 110, including front panel cutout 112, and lower slot 114.

The blanks may be made of a sheet material such as paperboard, plastic, or other suitable substrate. The front blank 102 and back blank 101 may be made of the same material, or different materials.

Figure 2:
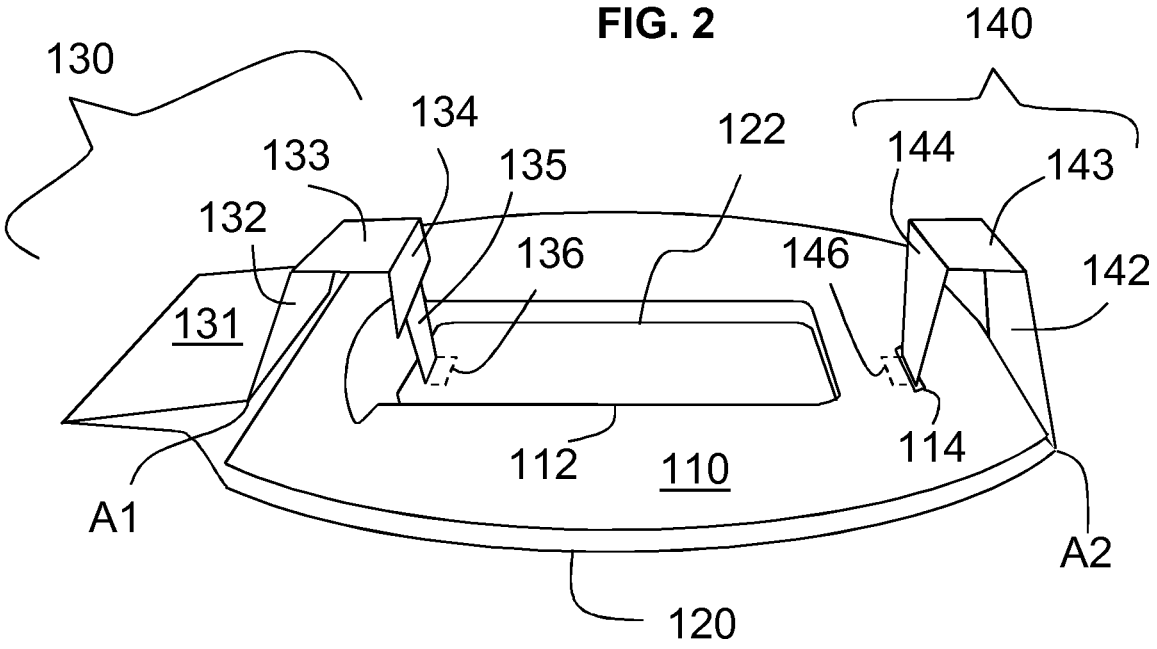
FIG. 2 is a perspective view of a package made from the blanks of FIG. 1.

FIG. 2 is a perspective view of the blanks folded and assembled as follows, describing the various panels as seen in the Figure. For simplicity, a blister to be used with the package is not yet shown in the Figure. Back panel 120 is generally behind (or in this view, below) front panel 110. As seen at the left of the Figure, the upper channel 130 may be formed as follows. Fold-back panel 131 may be folded to the right and onto back panel 120. Upper channel outer wall 132 may be folded upward relative to fold-back panel 131. Upper channel roof 133 may be folded downward to the right and me then be approximately horizontal. Upper channel inner wall 134 and upper channel pass-through tab 135 may be folded downward toward the front panel 110 and back panel 120. Finally upper channel glue tab 136, having passed through the plane of back panel 120, may be folded horizontally as shown in the dashed line.

As seen at the right of the Figure, the lower channel 140 may be formed by folding lower channel outer wall 142 upward relative to back panel 120. Lower channel roof 143 may be folded downward to the left and may then be approximately horizontal. Lower channel inner wall 144 may be folded downward toward the front panel 110 and back panel 120. Finally lower channel glue tab 146, having passed through the lower slots 114, 124, may be folded horizontally behind back panel 120 as shown in the dashed line.

From FIG. 2, it is seen that the proximal portions A1, A2 of the upper channel 130 and lower channel 140 respectively are attached either directly or indirectly by fold lines to the base, that is, to back panel 120, while the distal ends (glue flaps 136, 146 respectively) are attached to the base (for example back panel 120) by glue or tape or other method after having passed through or below back panel 120. However, instead of being attached to the back surface of back panel 120, the glue flaps could instead be secured to the front surface of back panel 120 or front panel 110.

The panels described thus far may be considered the base of a package. A blister will also be utilize in the package, and may be attached to the base as described below.

Figure 3:
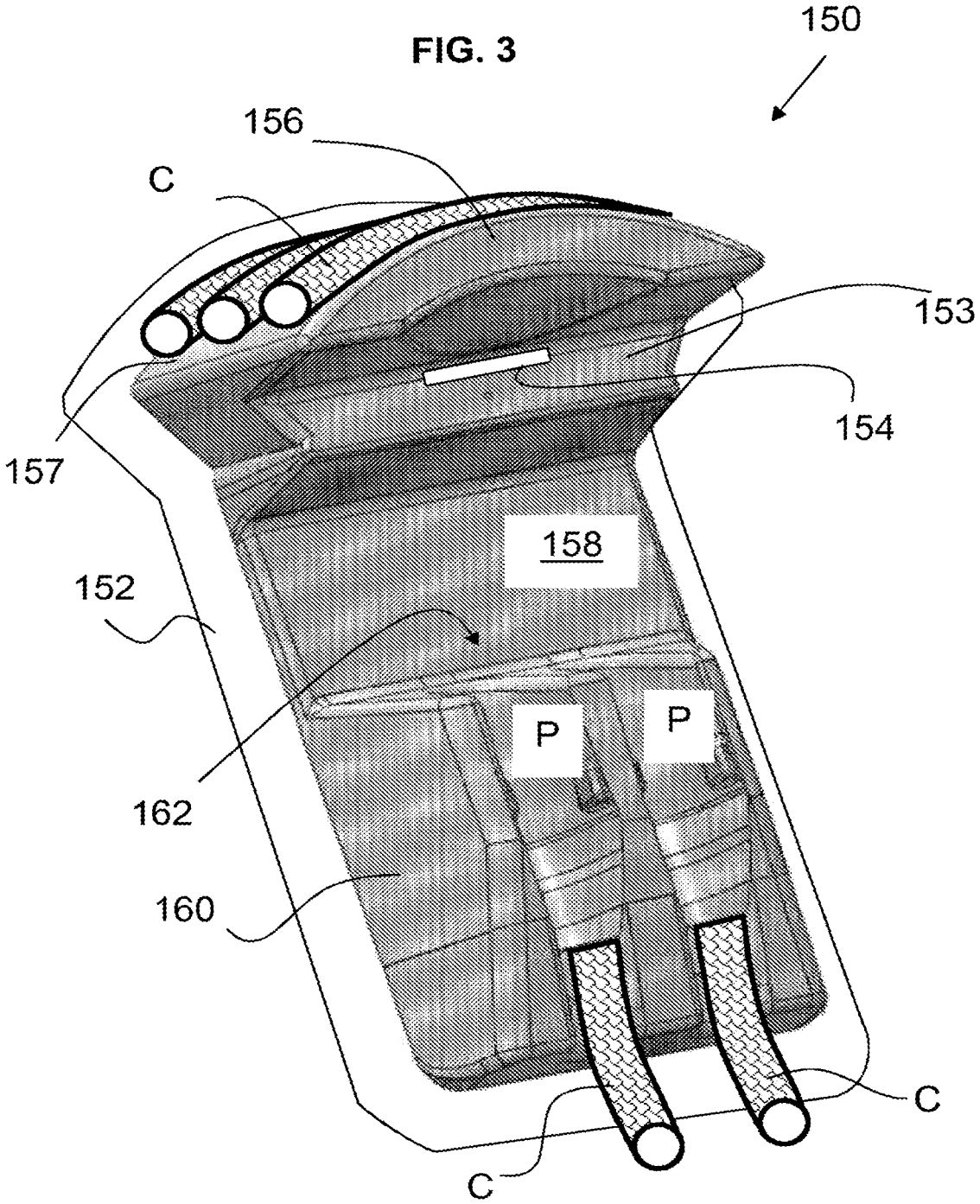
FIG. 3 is a perspective view of a blister to be used in the package of FIG. 2.

FIG. 3 is a perspective view of a blister 150 that may be used in the package. Many forms of blister may be utilized, depending upon the product being held in the package. Blister 150 may have a peripheral flange 152 that may be received between the front panel 110 and back panel 120. The blister 150 may include a shoulder 156 for supporting a product such as a cable C. The shoulder 156 may provide a supporting surface 157 that in the finished package 100 may form part of the interior wall of channel 130. The supporting surface 157 may be curved, which may be particularly advantageous for products such as cable C that may be displayed in a curved form. The blister may include a holder 160 which may have one or more receptacles 162 to receive items such as plugs P on the ends of cable C. The blister 150 may have a floor 158. The blister may also have a blister pass-through slot 154. The blister pass-through slot 154 may be located proximate a blister shelf 153.

The blister may be transparent, translucent, or opaque. The blister may, for example, be a thermoformed plastic although other materials may also be used. Blister may be made in one or more parts, which parts may be joined together or to the paperboard panels, for example by adhesive, or by heat sealing or welding as appropriate (e.g. for plastics or coated paperboard), or by snap fit or other method of holding the parts together.

Figure 4:
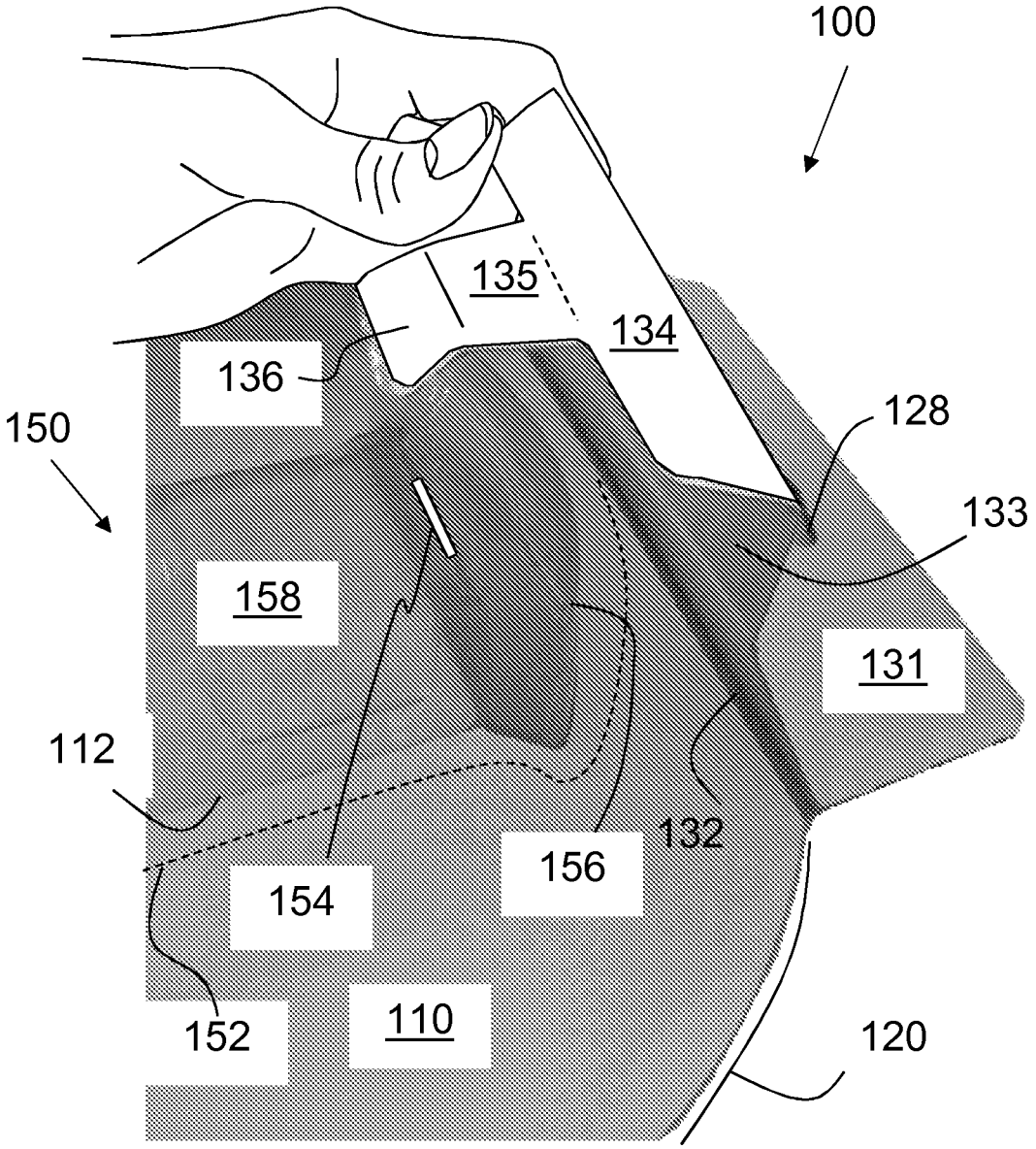
FIG. 4 is a perspective view of the package in a step of being assembled around a part of the blister.
Figure 5:
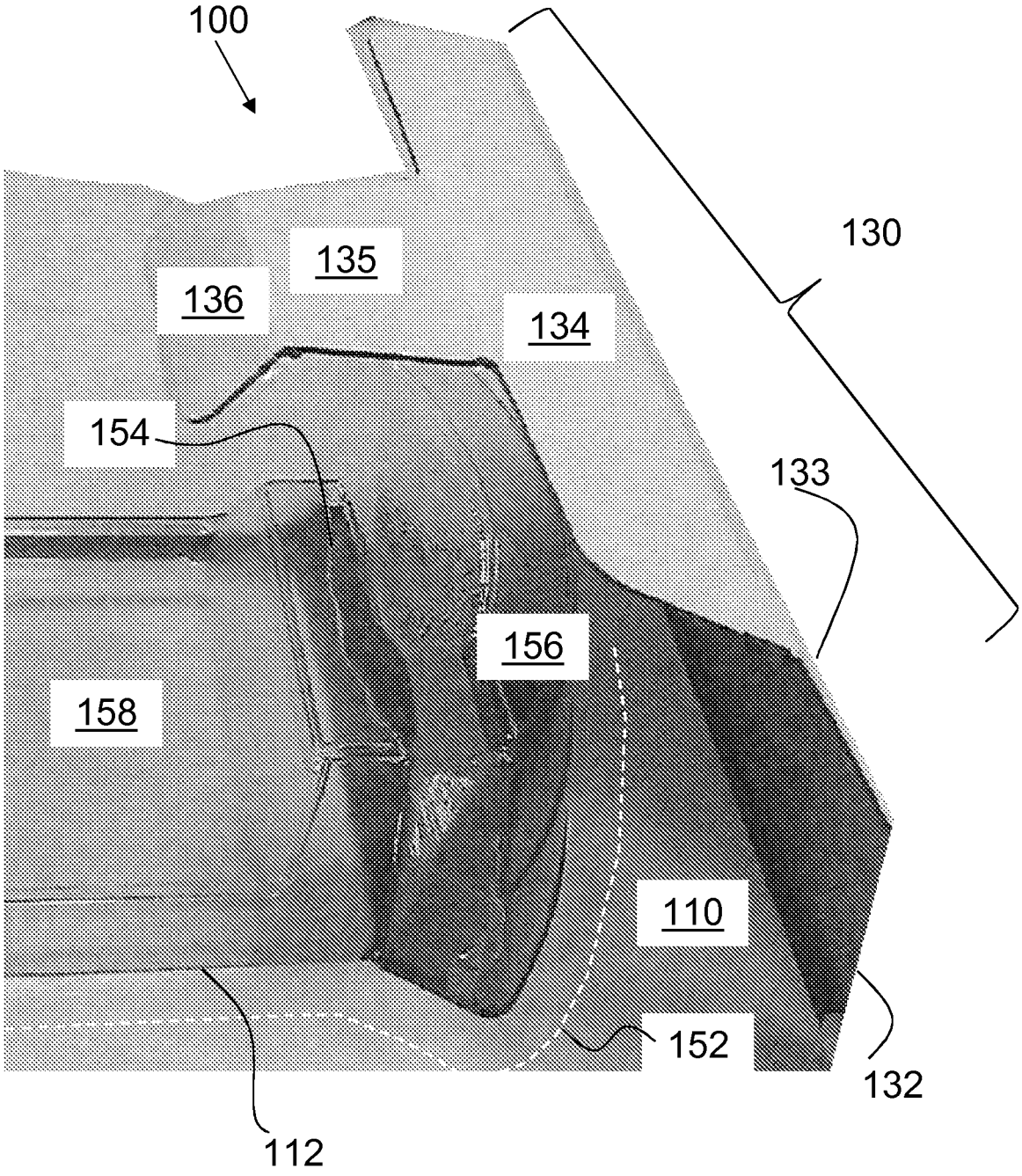
FIG. 5 is a detail view of the package shown in FIG. 4.

FIG. 4 is a perspective view of the package 100 in a step of being assembled around the blister 150. To reach the assembly shown in FIG. 4, the back panel 120 folded as shown in FIG. 2 may be laid flat, and the blister 150 placed upon back panel 120. The front panel 110 may be lowered onto the blister 150, which protrudes forward through front panel cutout 112. The blister flange 152 is then between the front panel 110 and back panel 120 and may be sealed therebetween. The blister shoulder 156 rises above the front panel 110. The upper channel glue tab 136 and upper channel pass-through tab 135 may be placed down through blister pass-through slot 154. FIG. 5 provides a detail view of the area around blister shoulder 156. The upper channel glue tab 136 and upper channel pass-through tab 135 are seen prior to their being moved through blister pass-through slot 154.

Figure 6:
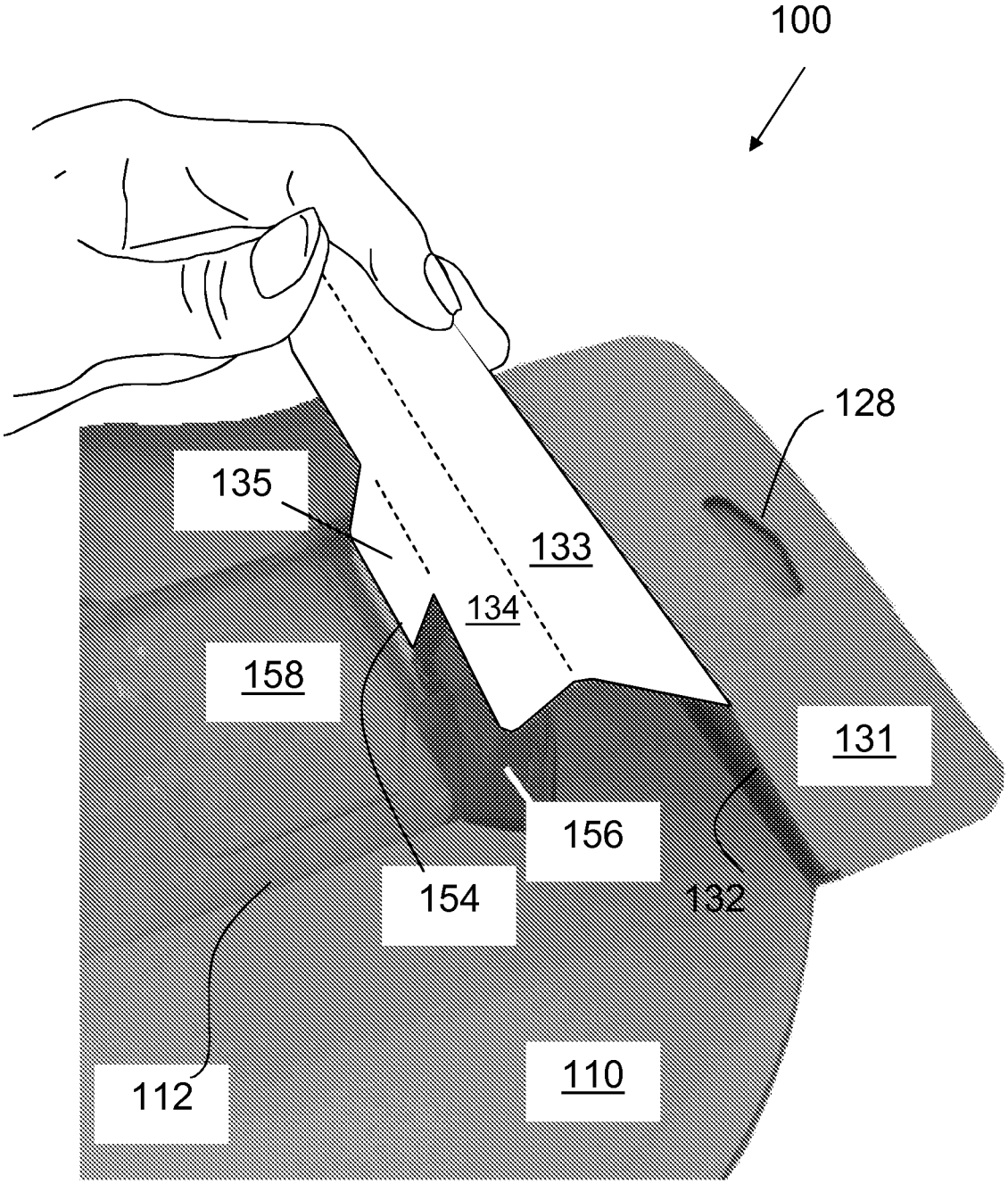
FIG. 6 is a perspective view of the package in a further step of being assembled around a part of the blister.

FIG. 6 is a perspective view of package 100, in a further step of being assembled around the blister. The upper channel glue tab 136 is not directly visible, having just been placed into the blister pass-through slot 154. The upper channel pass-through tab 135 is about to be moved down through the blister pass-through slot 154.

Figure 7:
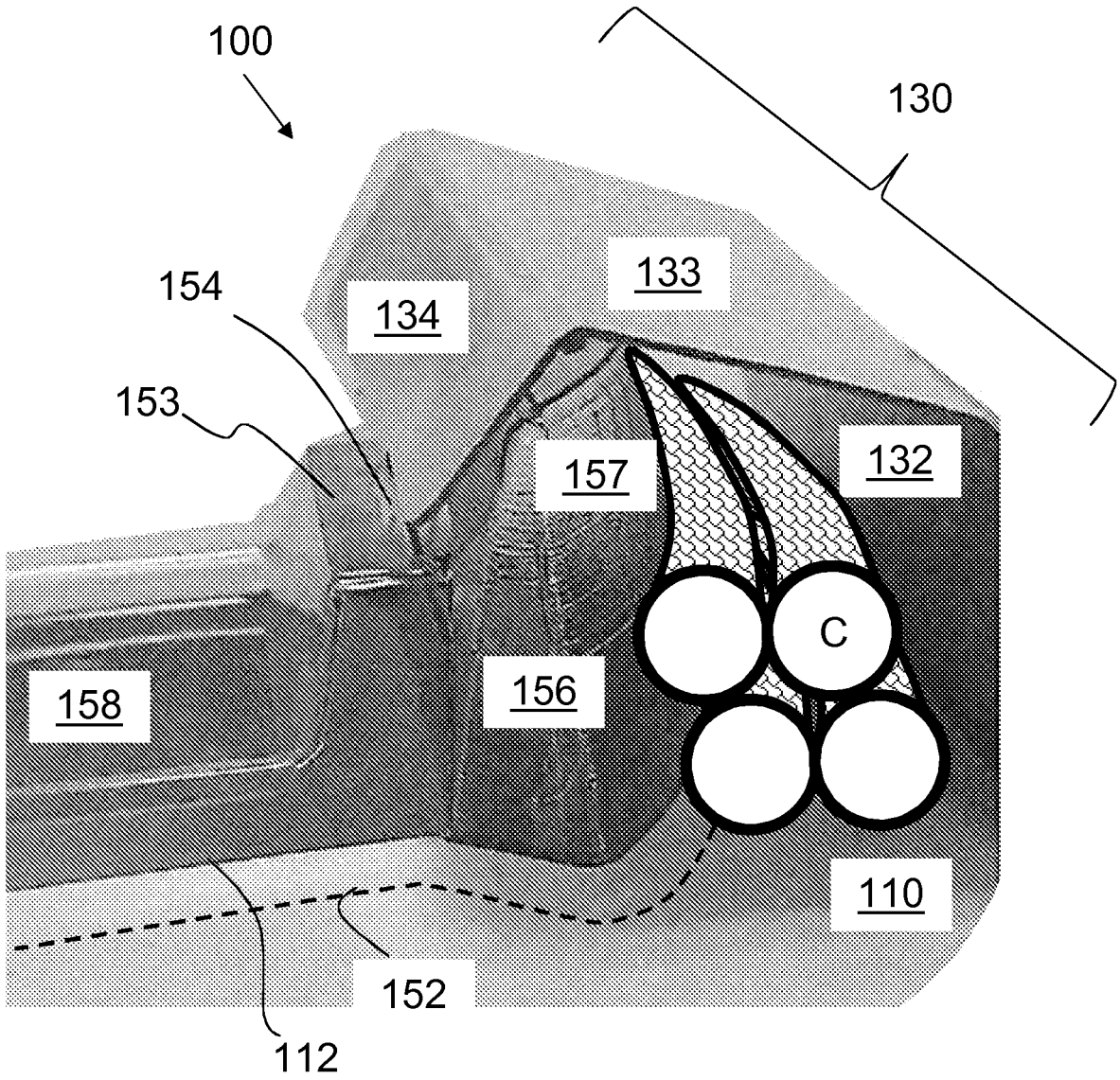
FIG. 7 is a detail view of the package shown in FIG. 6.

FIG. 7 is a detail view of the package shown in FIG. 6. Once the upper channel pass-through tab 135 is inserted through the blister pass-through slot 154, the upper channel inner wall 134 may rest upon the blister shelf 153. However, instead of providing a blister shelf 153 and a blister pass-through slot 154 located partway up the blister shoulder 156 (e.g., on or proximate the blister shelf 153), the blister shelf 153 may be lower or may be omitted, and the blister pass-through slot 154 be lower down on the blister. In certain blister designs, the blister shelf 153 and/or blister floor 158 may be omitted and the upper channel glue tab 136 (and optionally upper channel pass-through tab 135 if provided) may pass through a slot or slots in the front panel 110 and/or back panel 120.

Before the final assembly step, product such as cable C may be placed in the package, for example passing through the upper channel 130 (and lower channel 140) and being supported upon blister shoulder 156.

As illustrated in FIG. 7, the package 100 is seen to include at least one channel (e.g., upper channel 130) with two open ends, which receives a product (e.g. cable C) extending through the channel. Furthermore, within the channel and forming at least part of the interior surface of the channel is a supporting part of blister 150 (e.g. shoulder 156). The product may rest upon the supporting part of the blister.

Figure 8:
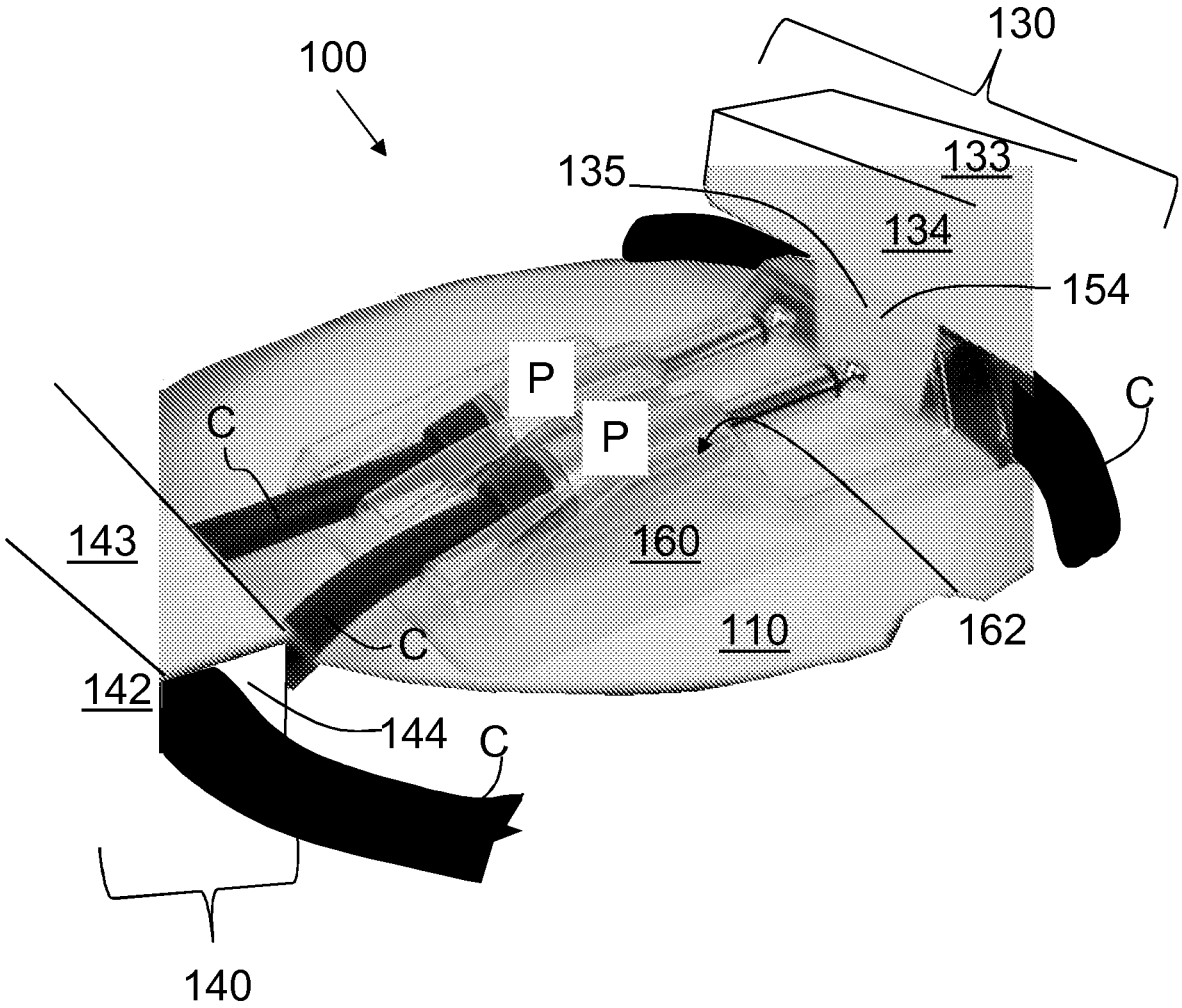
FIG. 8 is a perspective view from above the package, showing portions of a product being held by the blister.

FIG. 8 is a perspective view from above package 100, showing cable C being held in the package and passing through upper channel 130 and lower channel 140. Portions of a product such as plugs P are shown held by receptacles 162 in the holder 160. Slots 149 (see FIG. 1) may be provided in the lower channel inner wall 144 to receive the cable C into lower channel 140 immediately below plugs P.

Figure 9:
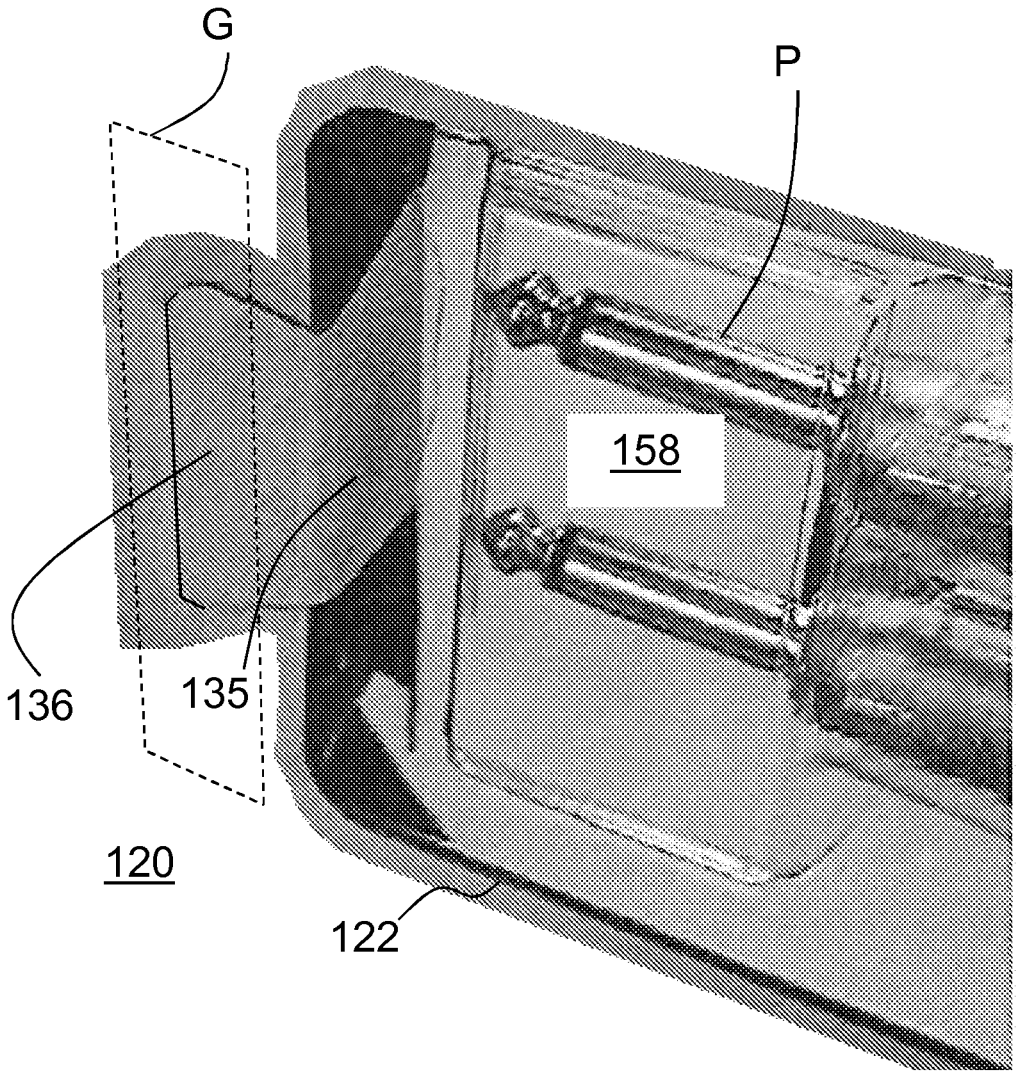
FIG. 9 is a perspective view from below the package, showing a detail.

FIG. 9 is a perspective view from below the package, showing a detail of the upper channel glue tab 136. After the glue tab 136 has been passed down through blister pass-through slot 154 (not shown in FIG. 9), the glue tab 136 may be folded against back panel 120 and glued or taped thereto, as denoted by tape G. Plugs P are seen visible through the transparent floor 158 of the blister. As shown in FIG. 9, a transparent blister used with a back panel cutout 122 allows product visibility from the back of the package. However, back panel cutout 122 may be omitted, and the glue tab 136 instead passed through upper slot 124A (see FIG. 1).

As described thus far, the base of the package has included two panels—a front panel 110 and a back panel 120—with a blister 150 whose flange 152 is held between the panels. Thus much of the base is two plies of material. This may be advantageous since much of the exposed surface of the panels (excepting the interior of the upper channel 130 and lower channel 140) may be the coated side of a coated-one side (CIS) substrate. It should be understood however that the base of the package could be a single ply of material, for example made only from back blank 101. In such a case the flange 152 of blister 150 may be attached by gluing or other method to the front surface of back panel 120, instead of being held between the front panel 110 and back panel 120.

FIGS. 10-22 are perspective views of additional packages for holding a product item. In some embodiments the package may include a base made of sheet material; a first blister portion attached to the base, the first blister portion shaped to receive at least a portion of the product item, while leaving the product item substantially exposed; and a holding feature attached to the base and securing the product item to the package.

In certain embodiments the base may include a front panel and a back panel, and the first blister portion may include a flange received between the front panel and back panel. In certain embodiments, the base includes at least one ply of sheet material and the first blister portion is attached to a front surface of the base.

In certain embodiments, the holding feature is a second blister portion attached to the base. In certain embodiments, the holding feature is a strap of sheet material attached to the base. In certain embodiments, the holding feature wraps around the product item.

In certain embodiments, the strap of sheet material is paperboard or plastic. In certain embodiments, the strap has at least one end, the base includes two plies of material, and the at least one end is sealed between the two plies.

In certain embodiments, the sheet material of the base is paperboard. In certain embodiments, the first blister portion is plastic.

Figure 10:
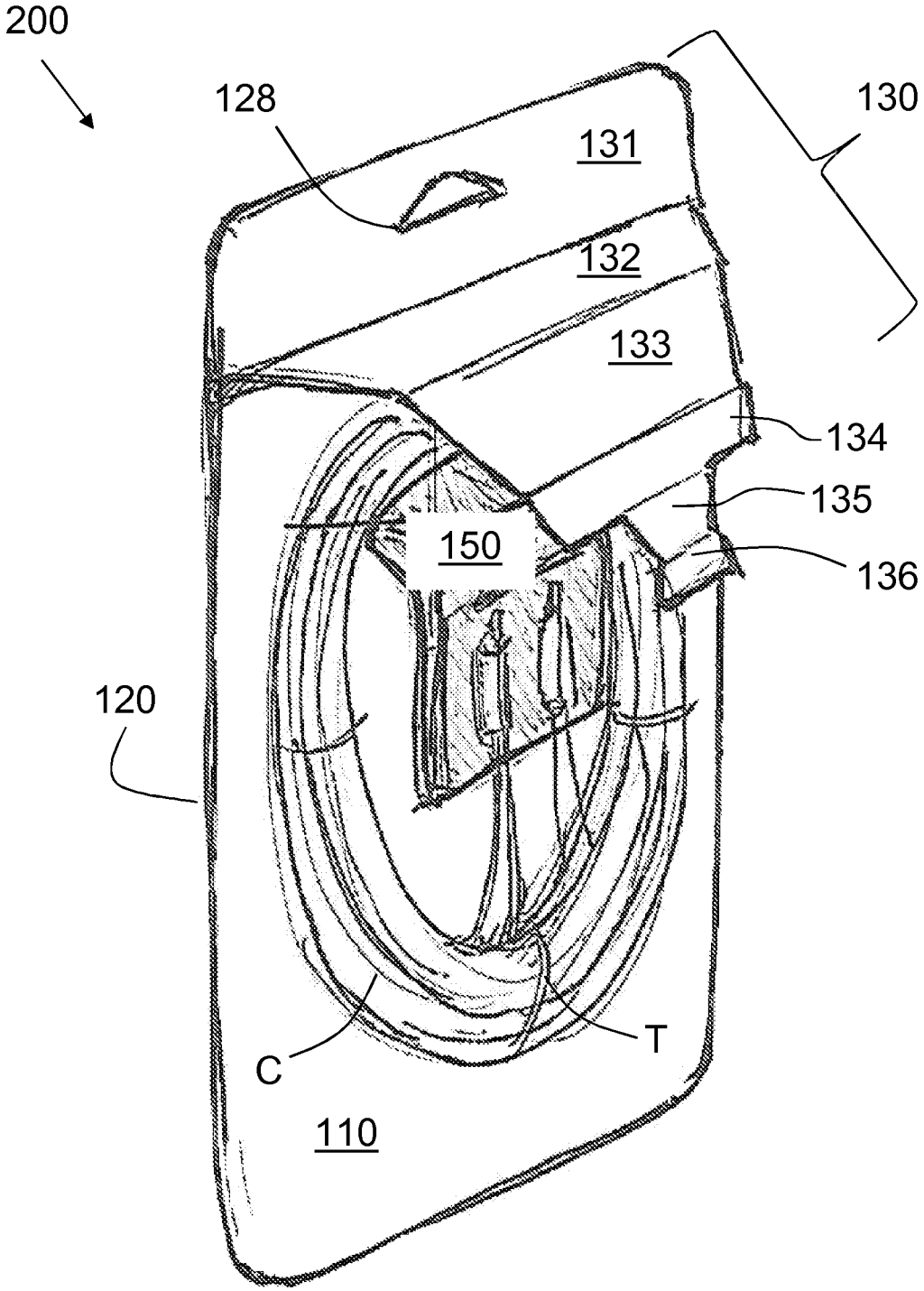
FIGS. 10-12 are perspective views of additional packages.

In FIG. 10, package 200 is shown which is similar in some respects to the package 100 described previously. However, while provided with an upper channel 130, package 200 may lack a lower channel. Ties T may be used to help support and retain a product such as cable C.

Figure 11:
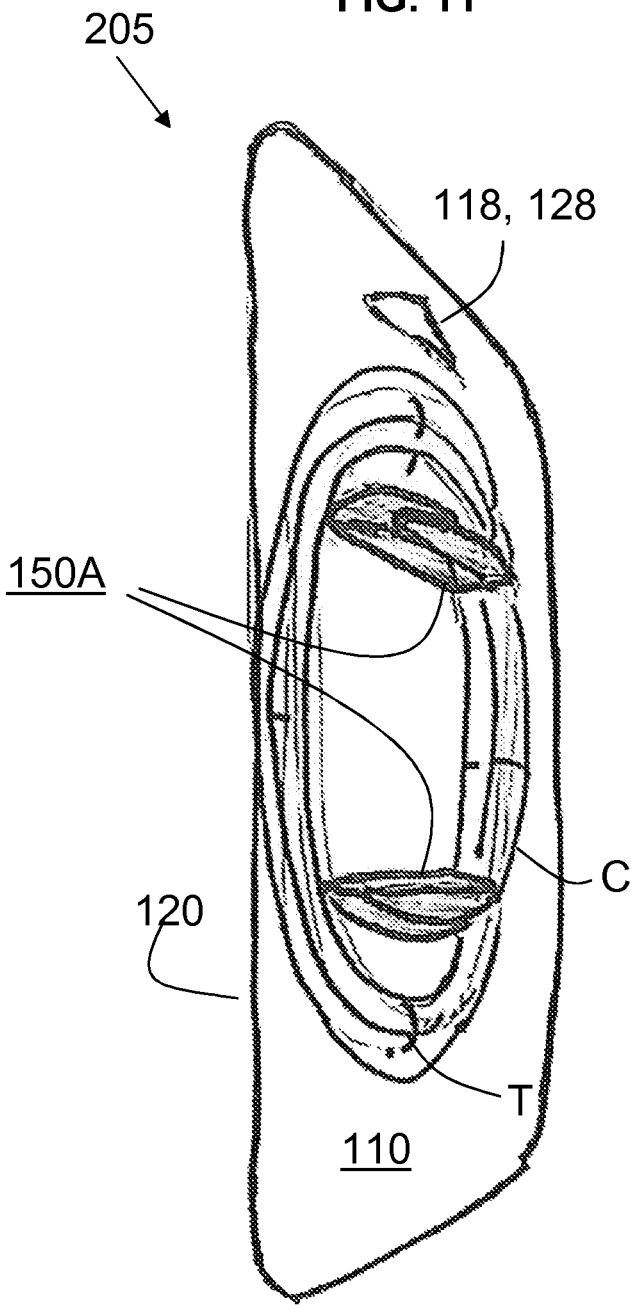

In FIG. 11, package 205 is shown which is similar in some respects to the packages described previously. However, while not utilizing an upper channel or lower channel, blister or blisters 150A may be provided to help support and retain the shape of a product such as cable C. Blisters 150A may be a single piece or separate pieces. The front panel 110 and/or back panel 120 may have suitable cutouts to receive the blister 150A. Ties T may be used to help support and retain the product. Hang holes 118, 128 may be provided on the panels.

Figure 12:
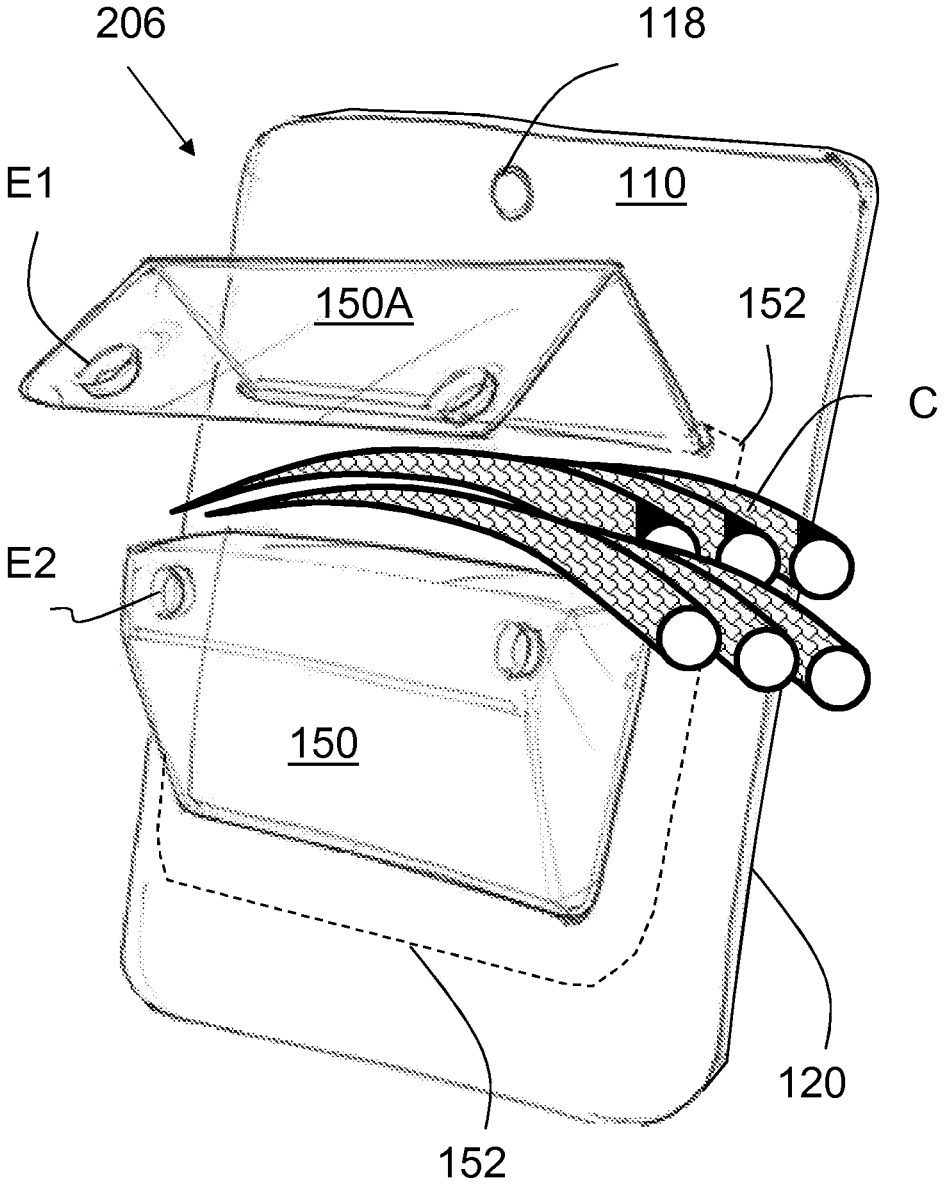

In FIG. 12, package 206 is shown which is similar in some respects to the packages described previously. Blister or blisters 150, 150A may be provided to help support and retain the shape of a product such as cable C. The blisters may be a single piece or separate pieces and may be provided with peripheral flange 152 to be attached to front panel 110 and/or back panel 120 (or sandwiched between the panels). As seen in FIG. 12, a supporting blister 150 may have a 3-dimensional shape, while a wrap-around blister part 150A (which may be an extended part of blister flange 152) may have engaging features E1 (such as protrusions) to connect with engaging features E2 (such as depressions) on supporting blister 150. The front panel 110 and/or back panel 120 may have suitable cutouts to receive the blisters 150, 150A. Wrap-around blister part 150A may be considered a holding feature or strap to secure the cable C to package 206.

Figure 13A:
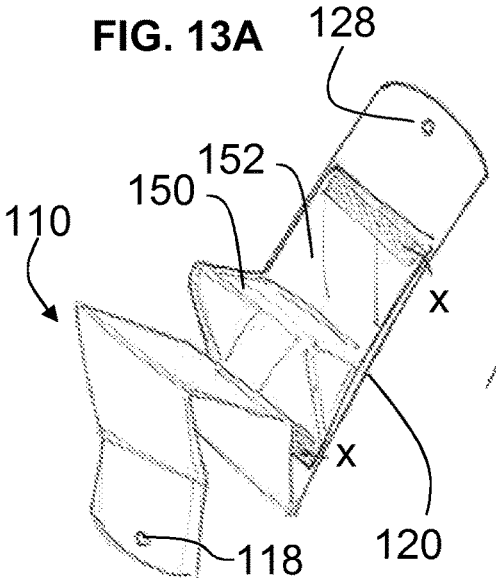
FIGS. 13A-16B are perspective views of additional packages.
Figure 13B:
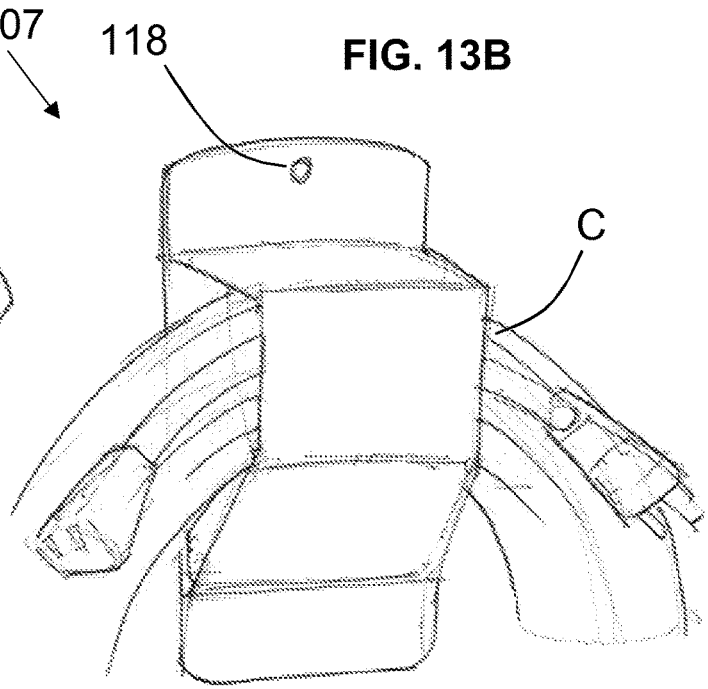

In FIG. 13A, partially assembled parts are shown for what will become package 207 shown in FIG. 13B. The package is similar in some respects to the packages described previously. Blister or 150 may be provided to help support and retain the shape of a product such as cable C. The blister may be provided with peripheral flange 152 that may be attached to back panel 120 (for example by attaching at points X) or may be sandwiched between back panel 120 and front panel 110. As seen in FIG. 12A, the parts of front panel 110 may be wrapped around the front of the blister 150 to form an enclosed channel to hold cable C, while the cable is generally supported on blister 150. The parts of front panel 110 may thus be considered a holding feature or strap to help secure the cable C to the package 207.

In the examples described thus far, the product is in the form of a cable, such as a video cable, network cable, microphone cable, etc. Other flexible elongated products may be housed in the package, such as electrical cables, garden hose, tubing, etc.

FIGS. 14-22 show embodiments where the card and blister support various product items in the form of hand tools or hardware items. These product items are only examples, as it will be understood that other product items such as power tools, kitchen utensils, small appliances, and the like may be packaged in similar fashion.

Figures 14A, 14B:
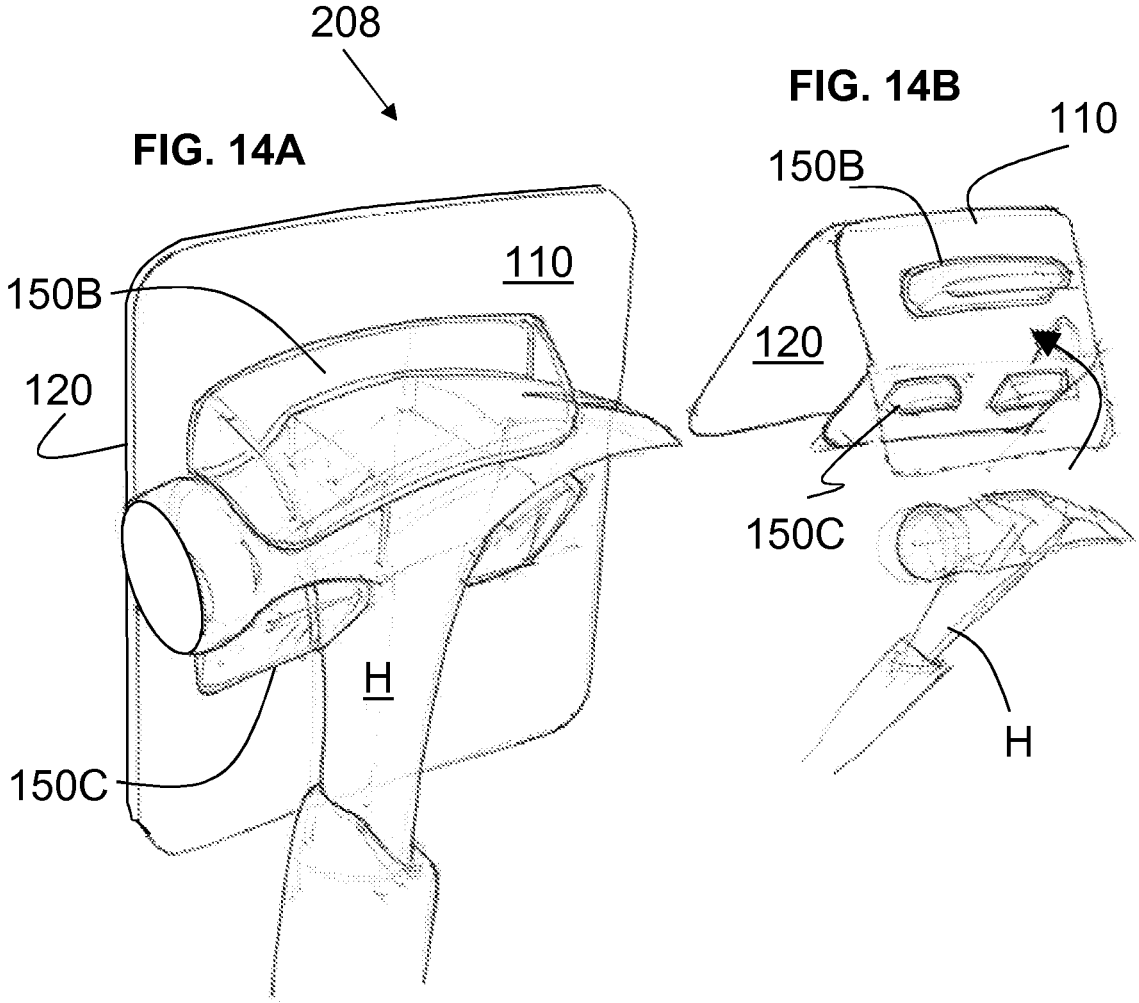

In FIG. 14A, a hammer H is shown supported on package 208. The package may include supporting blisters 150C and overcap blister 150B which together securely hold hammer H. The partially assembled package is shown in FIG. 14B. The blister or blisters may be provided with peripheral flanges (not shown) that may be attached to back panel 120, front panel 110, or sandwiched between back panel 120 and front panel 110. As seen in FIG. 14B, during package assembly, the panels and/or blisters may be flexed to allow hammer H to be placed between supporting blister(s) 150C and cap blister 150B. The front panel 110 and back panel 120 may then be attached together, which brings the blister parts together to hold the head of hammer H. Thus supporting blisters 150C may work with cap blister 150B (which may be considered a holding feature) to secure the hammer H to package 208.

Figure 15A:
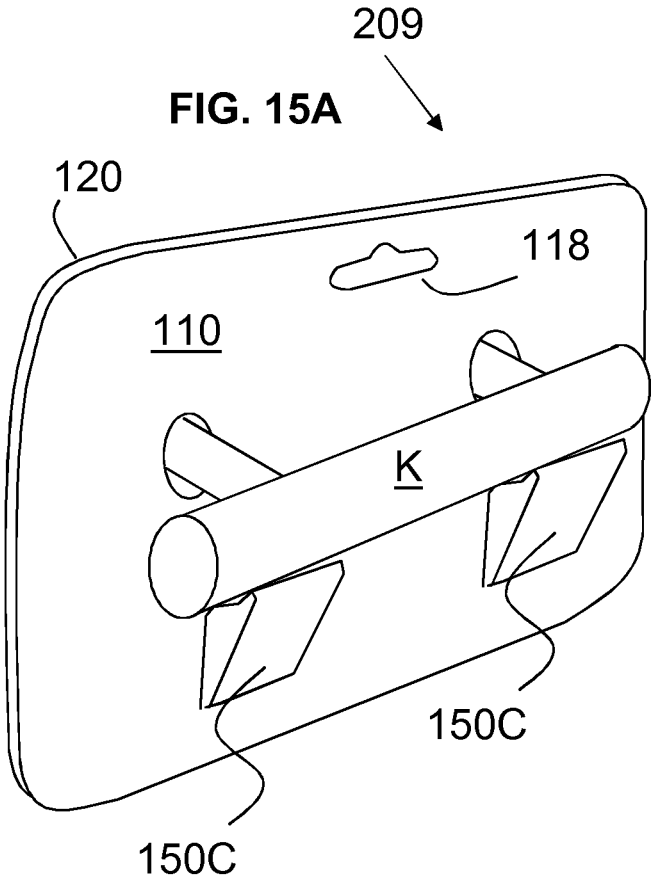
Figure 15B:
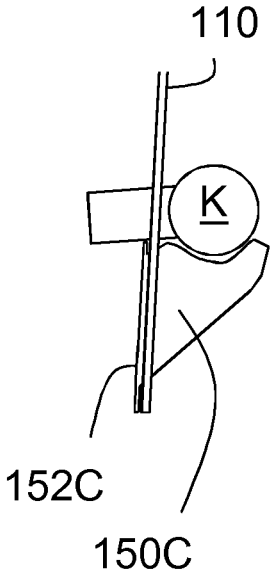

In FIG. 15A, a product item K (such as a drawer pull, towel rack, etc.) is shown supported on package 209. The package may include supporting blisters 150C to hold item K. A side view of the package is shown in FIG. 15B. The blister or blisters may be provided with peripheral flanges (not shown) that may be attached to back panel 120, front panel 110, or sandwiched between back panel 120 and front panel 110. The front panel 110 and back panel 120 may be attached together. Openings may be provided in the panels to provide clearance for certain parts of item K.

Figure 16A:
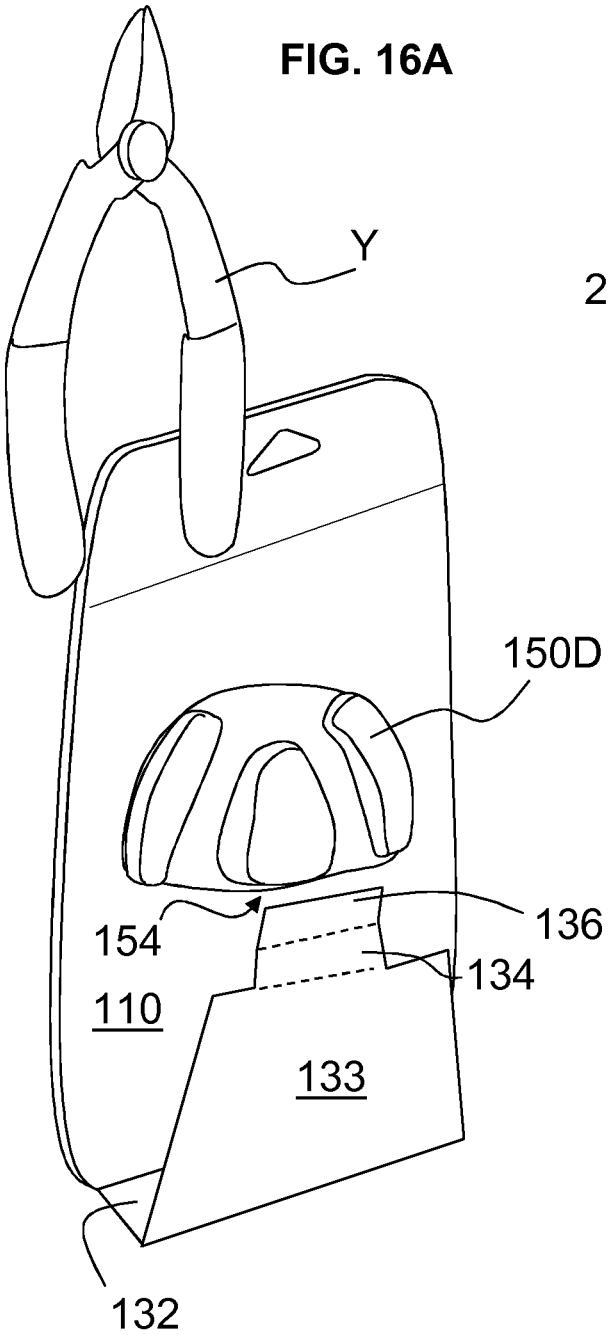
Figure 16B:
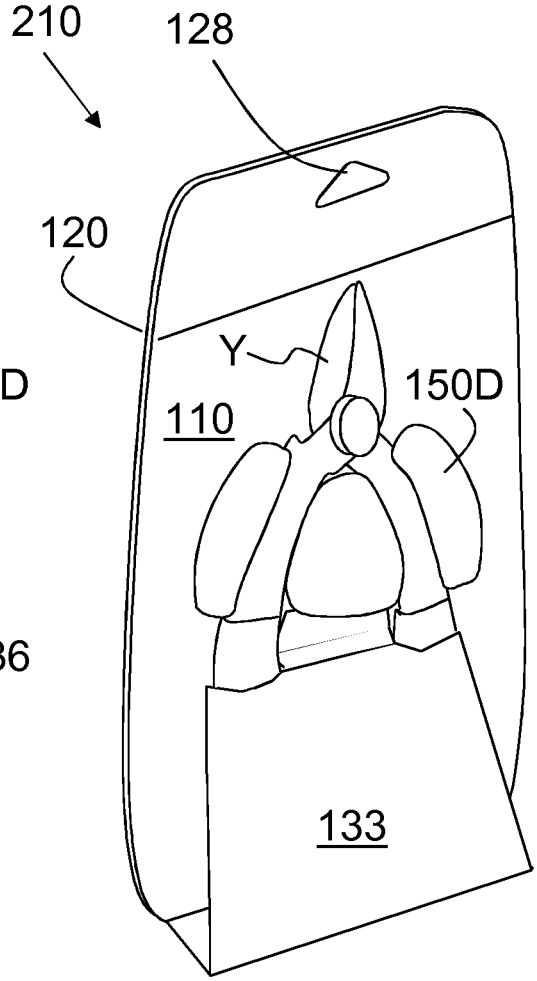

In FIG. 16A, pliers Y are shown adjacent partially assembled parts to make package 210 seen in FIG. 16B. The package may include supporting blister 150D which is shaped to hold pliers Y, for example by providing grooves or channels in blister 150D. The blister or blisters may be provided with peripheral flanges (not shown) that may be attached to back panel 120, front panel 110, or sandwiched between back panel 120 and front panel 110. The front panel 110 and back panel 120 may be attached together. The lower part of the package may include panels 132,133, and 134 that may wrap around the lower part of the pliers Y, and a fastening tab 136 that may be fastened to one or both panels, optionally passing through a slot in the panel(s). Alternately, fastening tab 136 may be received or anchored into a slot 154 in blister 150D. The panels 132, 133, 134 may be considered a holding feature or strap by which the pliers P are secured to the package 210. The supporting blister 150D may itself have multiple holding sites (e.g. one for each arm of the pliers Y) to help secure the pliers Y to package 210.

Figure 17:
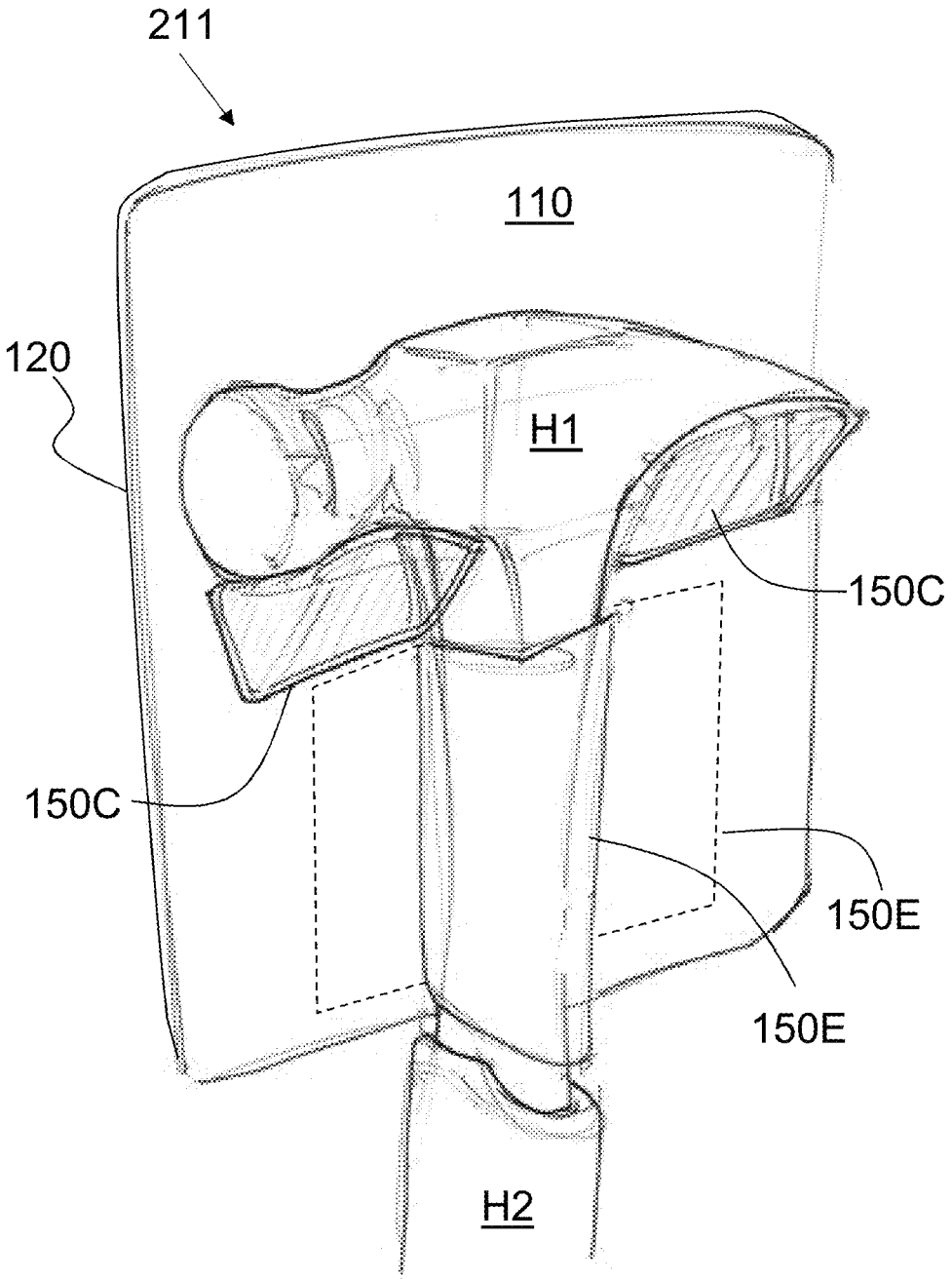
FIG. 17 is a perspective view of another package.

In FIG. 17, a hammer is shown received in package 211. The package may include supporting blisters 150C shaped to hold the hammer head H1, for example contoured to fit the lower part of the head. The blister or blisters may be provided with peripheral flanges (not shown) that may be attached to back panel 120, front panel 110, or sandwiched between back panel 120 and front panel 110. The front panel 110 and back panel 120 may be attached together. The lower part of the package may include strap 150E to secure the hammer handle H2. Strap 150E may, for example, be a paperboard strap that whose end or ends pass through an opening or openings in front panel 110, and are trapped between front panel 110 and back panel 120. Strap 150E may be considered a holding feature to secure the hammer to package 211.

Figures 18A, 18B:
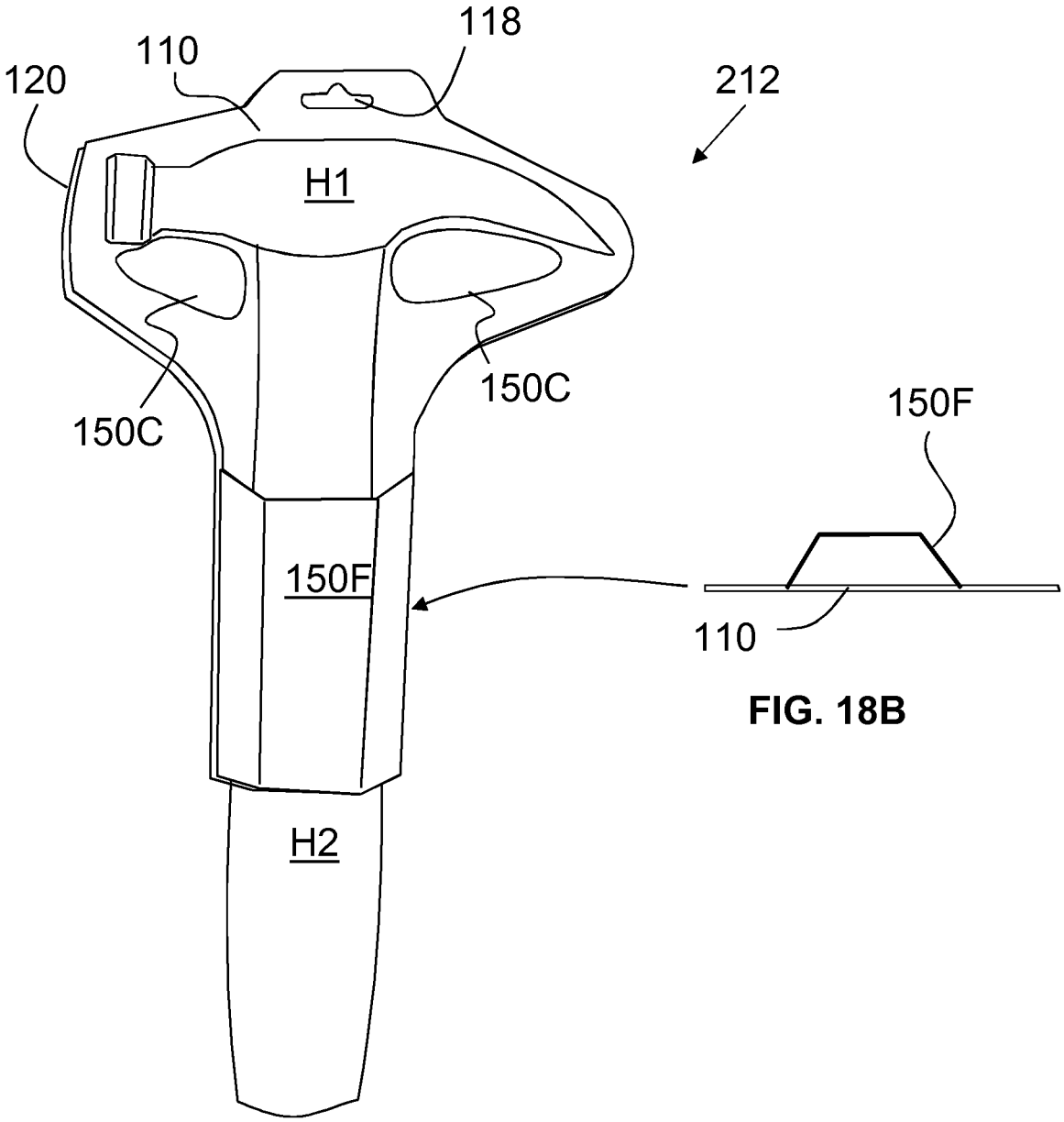

In FIG. 18A, a hammer is shown received in package 212. The package may include supporting blisters 150C shaped to hold the hammer head H1, for example contoured to fit the lower part of the head. The blister or blisters may be provided with peripheral flanges (not shown) that may be attached to back panel 120, front panel 110, or sandwiched between back panel 120 and front panel 110. The front panel 110 and back panel 120 may be attached together. The lower part of the package may include belt or strap 150F wrapping hammer handle H2. Strap 150F, shown in cross section in FIG. 18B, and also in several Figures to follow, may be an extension of front panel 110, back panel 120, or the blister flange. Strap 150F may be considered a holding feature to secure the hammer to package 212

Figure 19A:
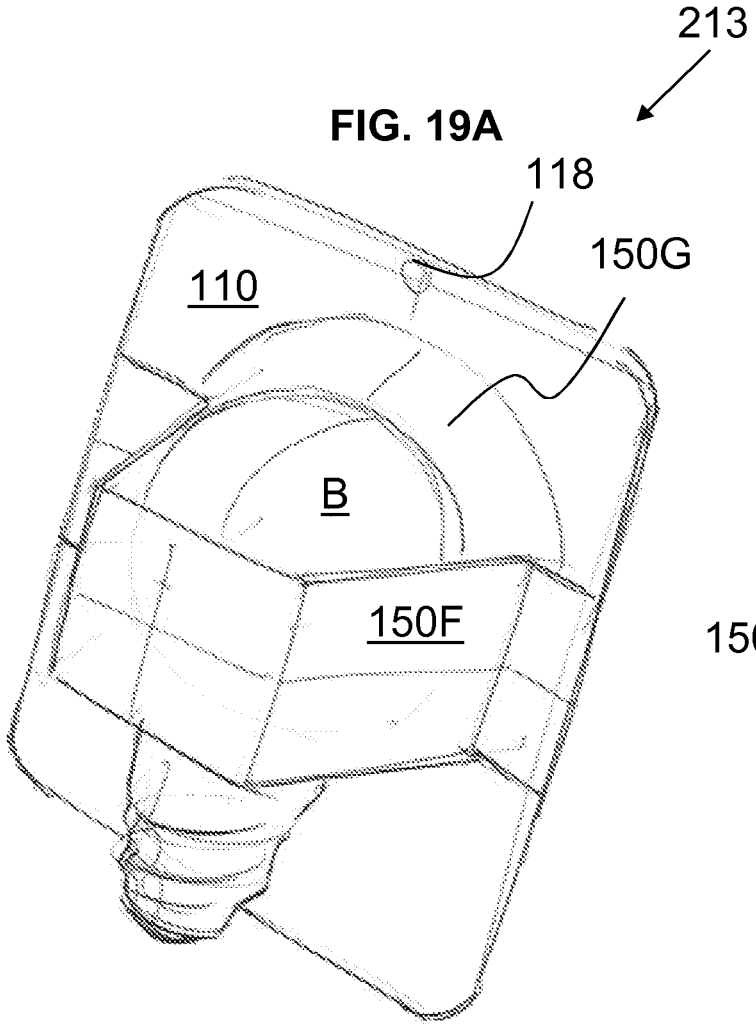
Figure 19B:
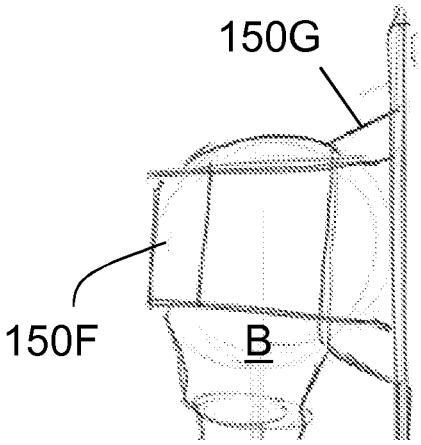

In FIG. 19A, a light bulb B is shown received in package 213. The package may include a contoured supporting blister 150G shaped to support and hold bulb B, either in the globe area as shown, or the base area, or both. Blister 150G may be provided with a peripheral flange (not shown) that may be attached to back panel 120, front panel 110, or sandwiched between back panel 120 and front panel 110. The front panel 110 and back panel 120 may be attached together. The package may include strap 150F wrapping bulb B and holding it against blister 150G. A side view of the package is shown in FIG. 19B. Strap 150F may be considered a holding feature to secure light bulb B to package 213.

Figures 20A, 20B, 20C, 20D:
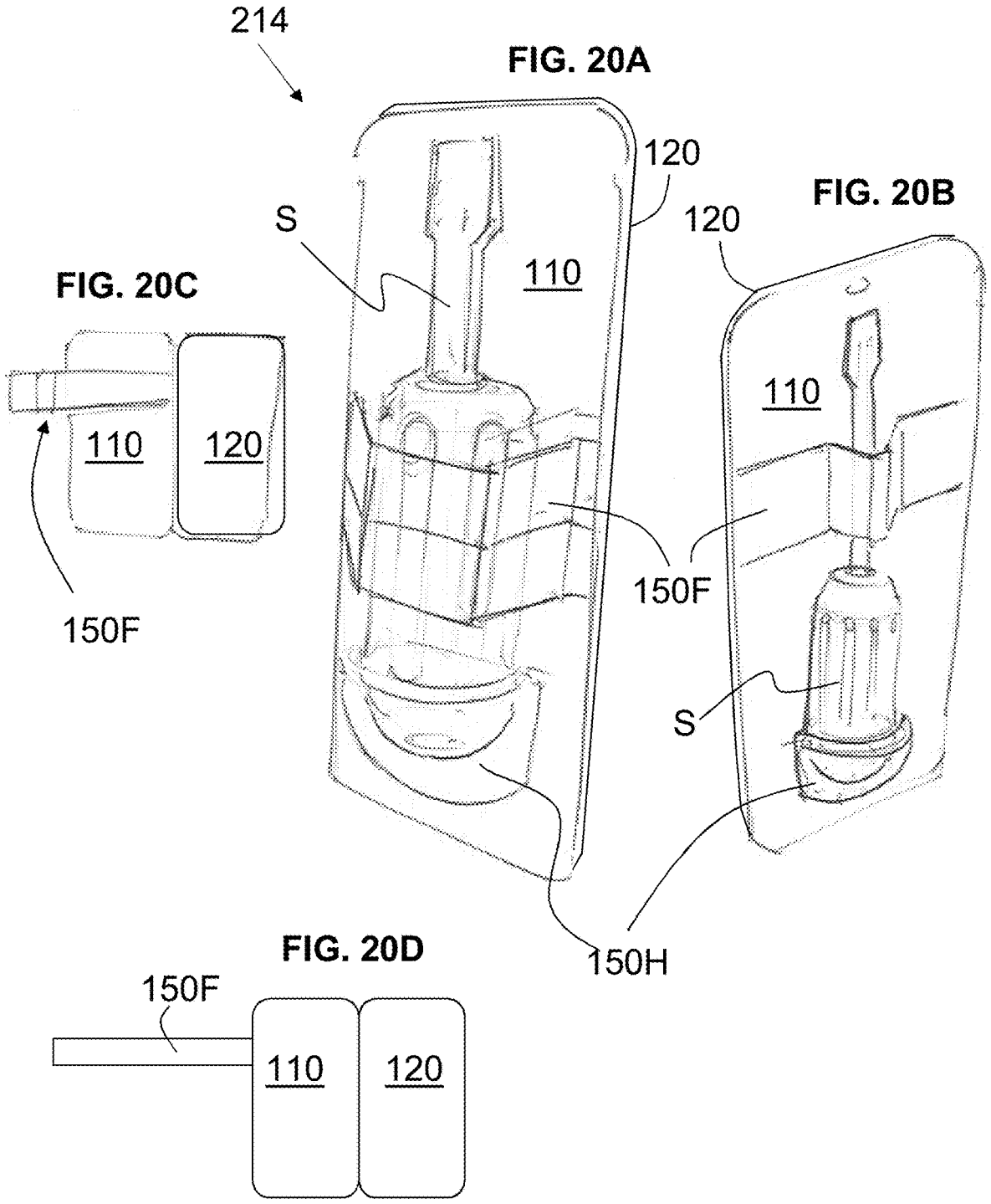

In FIGS. 20A and 20B, screwdriver S is shown received in package 214. The package may include a supporting blister 150H to support and hold part of the screwdriver (e.g., the handle). Blister 150H may be provided with a peripheral flange (not shown) that may be attached to back panel 120, front panel 110, or sandwiched between back panel 120 and front panel 110. The front panel 110 and back panel 120 may be attached together. The package may include strap 150F wrapping screwdriver S and holding it within the package. FIG. 20C shows an example blank for the package, where strap 150F may be cut from front panel 110. Strap 150F may be made long enough to extend across the width of front panel 110, with enough additional length to wrap around the handle or other portion of screwdriver S. Alternately the strap 150F may be a separate piece of material, or an extension of either front panel 110 or back panel 120, for example as shown in FIG. 20D. One or both ends of strap 150F may be attached to either panel or sandwiched between the panels. Strap 150F may be considered a holding feature to secure screwdriver S to package 214.

Figure 21:
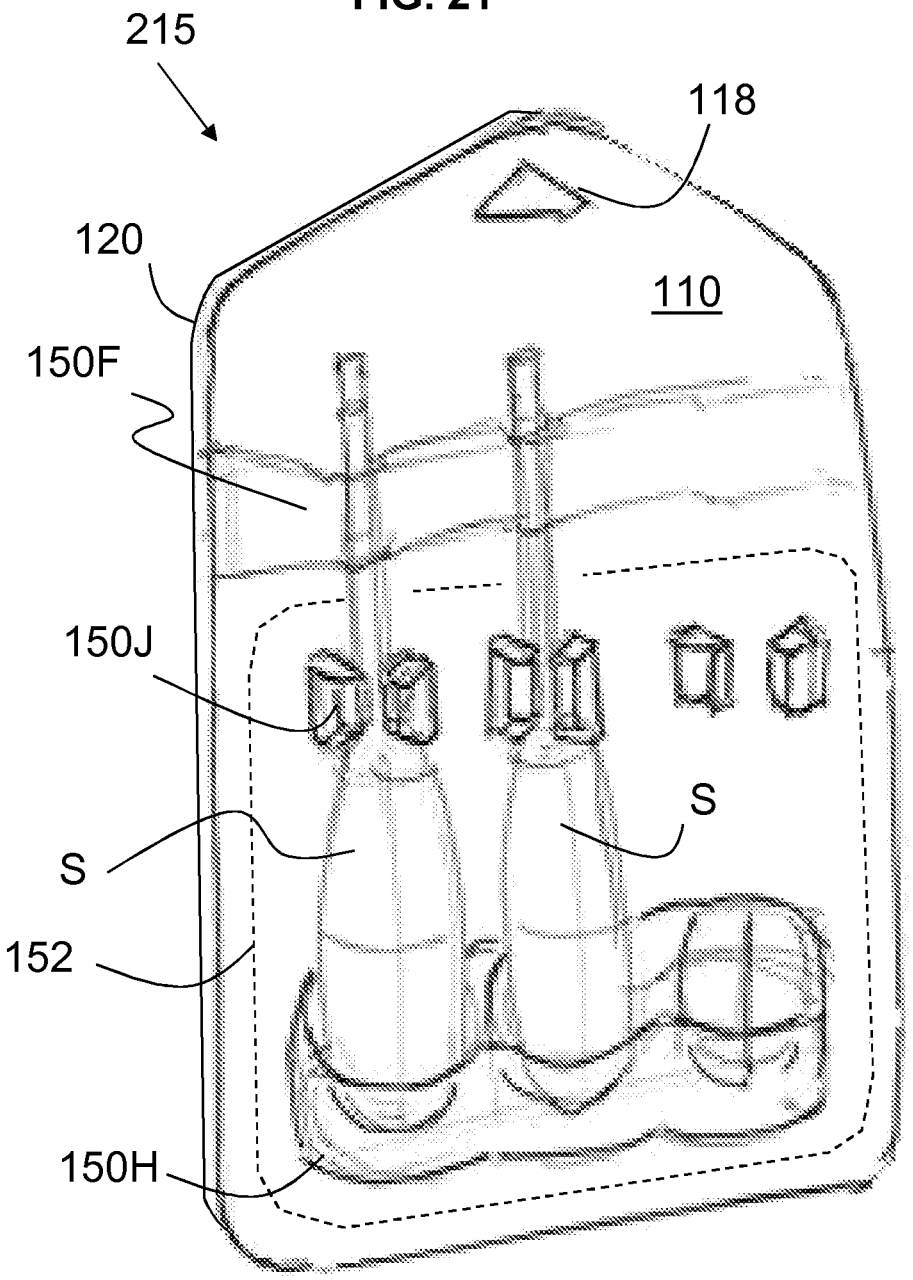
FIG. 21 is a perspective view of another package.

In FIG. 21, screwdrivers S are shown received in package 215. The package may include one or more supporting blisters 150H to support and hold parts of the screwdrivers (e.g., the handles). Blister 150H may be provided with a peripheral flange 152 that may be attached to back panel 120, front panel 110, or sandwiched between back panel 120 and front panel 110. Receptors 150J may be provided as small blisters or other plastic pieces attached to or extending from or through the panels. The receptors 150J may be parts of peripheral flange 152. The front panel 110 and back panel 120 may be attached together. The package may include strap 150F wrapping screwdrivers S and holding them within the package. Strap 150F may be considered a holding feature to secure the screwdrivers S to package 215.

Figure 22A:
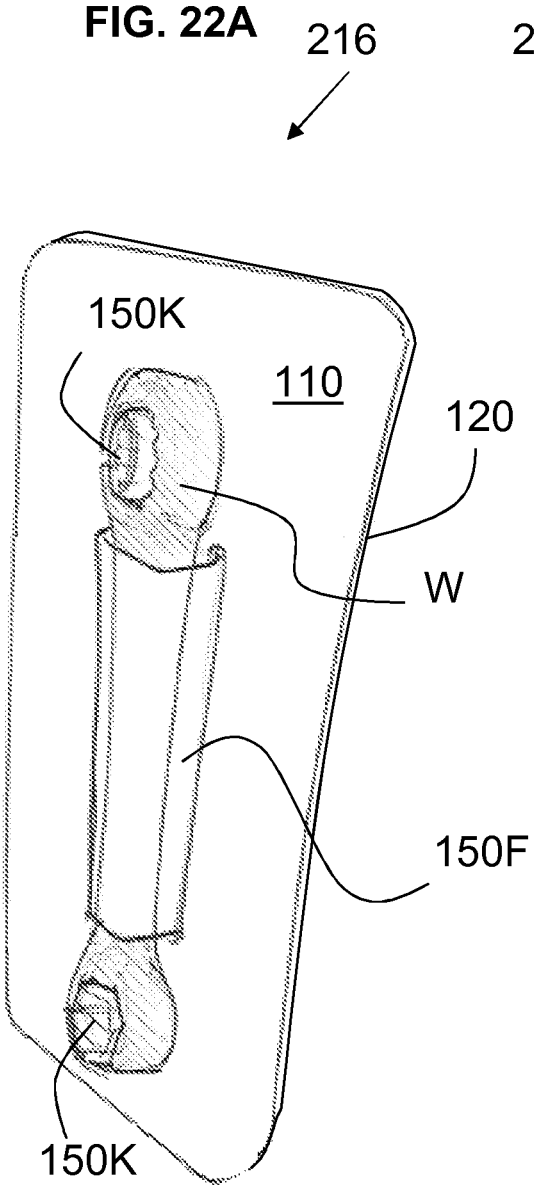
FIGS. 22A-22B are perspective views of another package.
Figure 22B:
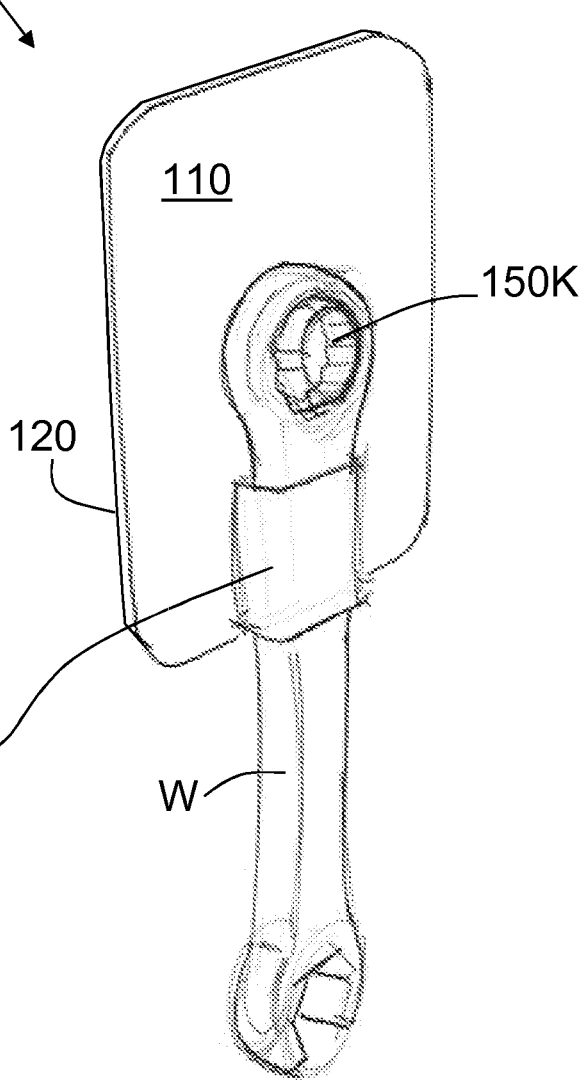

In FIGS. 22A and 22B, wrenches W are shown received in packages 216 and 217. The packages may include a supporting blister 150K to support and hold part of the wrench, for example, by extending through a box end or flare end opening of the wrench. Blister 150K may be provided with a peripheral flange (not shown) that may be attached to back panel 120, front panel 110, or sandwiched between back panel 120 and front panel 110. The front panel 110 and back panel 120 may be attached together. The package may include strap 150F wrapping wrench W and holding it within the package. Strap 150F may be considered a holding feature to secure wrench W to packages 216 and 217.

While many of the embodiments described here illustrate both a front panel 110 and back panel 120, it will be realized that for certain embodiments a single panel may be used.

The embodiments described above provide a wide variety of features. Many of these features can be interchanged between embodiments. Further embodiments are thus envisaged which use a selection of the features from those described above. The invention thus extends to cover packages having other combinations of the features described.

The invention claimed is:

1. A product package comprising a package and a product housed therein, the package comprising: a base made of sheet material, and comprising a first channel with two open ends; a blister attached to the base, the blister comprising a shoulder portion at least partly forming an interior wall of the first channel, wherein at least a portion of the product is disposed outside the blister within the channel and supported on an exterior surface of the shoulder portion, wherein the first channel is formed by a series of panels hingedly attached to one another and to the base, wherein a proximal end of the first channel is attached to the base through a fold line, and a distal end of the first channel is secured to the base, wherein the blister comprises a pass-through slot through which the distal end of the first channel passes.

2. The product package of claim 1, wherein the base is comprised of a front panel and a back panel, and the blister comprises a flange received between the front panel and back panel.

3. The package of claim 1, wherein the base comprises one ply of sheet material and the blister is attached to a front surface of the base.

4. The product package of claim 1, further comprising a second channel with two open ends.

5. The product package of claim 1, wherein the shoulder portion forming the interior wall is a curved surface.

6. The product package of claim 1, wherein the sheet material is paperboard.

7. The product package of claim 1, wherein the blister is plastic.

* * * * *